US007111799B2

(12) United States Patent
Batich et al.

(10) Patent No.: US 7,111,799 B2
(45) Date of Patent: Sep. 26, 2006

(54) NARROW DIAMETER NEEDLE HAVING REDUCED INNER DIAMETER TIP

(76) Inventors: Mark Batich, 4981 Hadaway Rd., Kennesaw, GA (US) 30152; Andrew T. Hunt, 495 Mountain Way, Atlanta, GA (US) 30342; Miodrag Oljaca, 322 Cove Dr., Avondale Estates, GA (US) 30002

( * ) Notice: Subject to any disclaimer, the term of this patent is extended or adjusted under 35 U.S.C. 154(b) by 522 days.

(21) Appl. No.: 10/362,777

(22) PCT Filed: Aug. 20, 2001

(86) PCT No.: PCT/US01/25961

§ 371 (c)(1),
(2), (4) Date: Jul. 23, 2003

(87) PCT Pub. No.: WO02/16059

PCT Pub. Date: Feb. 28, 2002

(65) Prior Publication Data

US 2005/0017099 A1 Jan. 27, 2005

Related U.S. Application Data

(60) Provisional application No. 60/226,839, filed on Aug. 22, 2000.

(51) Int. Cl.
*B05B 1/00* (2006.01)

(52) U.S. Cl. ..... 239/589; 138/109; 138/40

(58) Field of Classification Search ..... 239/589, 239/597, 599, 591, 601, 135, 13; 118/300; 138/40, 109; 427/305, 561, 126.6
See application file for complete search history.

(56) References Cited

U.S. PATENT DOCUMENTS

| | | | | |
|---|---|---|---|---|
| 3,393,988 | A * | 7/1968 | Blumenthal | 65/61 |
| 3,955,953 | A * | 5/1976 | Hauser | 65/17.6 |
| 3,985,535 | A * | 10/1976 | Bennett et al. | 65/61 |
| 4,635,851 | A * | 1/1987 | Zecman | 239/133 |
| 4,707,705 | A * | 11/1987 | Hara et al. | 347/47 |
| 4,945,286 | A * | 7/1990 | Phillips et al. | 313/105 CM |
| 5,464,154 | A * | 11/1995 | Nielsen | 239/1 |
| 5,573,185 | A * | 11/1996 | Schwarzkopf | 239/135 |
| 5,730,853 | A * | 3/1998 | Smith et al. | 205/210 |
| 6,019,298 | A * | 2/2000 | Raghavan et al. | 239/599 |
| 6,227,461 | B1 * | 5/2001 | Schroeder et al. | 239/135 |
| 6,336,708 | B1 * | 1/2002 | West et al. | 347/47 |

* cited by examiner

*Primary Examiner*—James Hook
(74) *Attorney, Agent, or Firm*—Wayne E. Nacker; Alfred H. Muratori

(57) ABSTRACT

Tubular needles have a reduced inner diameter tip portion that increases back pressure behind the tip portion. This constricted tip portion promotes improved atomization, particularly when the liquid passes through the needle at near-supercritical conditions. A preferred method for constricting the inner diameter of a needle tip is to dip the dip of the needle in an electroless plating solution, such as an electroless nickel solution.

27 Claims, 5 Drawing Sheets

NARROW DIAMETER NEEDLE HAVING REDUCED INNER DIAMETER TIP

This application is a 371 of PCT/US01/25961 filed on Aug. 20, 2001, which claims benefit of U.S. Provisional Application 60/226,839, filed Aug. 22, 2000.

The present invention is directed to narrow inner diameter needles having reduced inner diameter tips.

BACKGROUND OF THE INVENTION

U.S. Pat. No. 5,652,021 describes a flame-based deposition technique termed combustion chemical vapor deposition or "CCVD." U.S. Pat. No. 5,997,956 describes a CCVD process using near-supercritical fluid solutions. U.S. patent application Ser. No. 09/067,975 describes apparatus and process for "Controlled Atmosphere Chemical Vapor Deposition" or "CACVD." The teachings of each of the above-mentioned U.S. Patents and Applications are incorporated herein by reference. The techniques taught in these patents and applications provide for large-scale open-atmosphere deposition of a variety of materials as thin layers on various substrates and also provide for production of powders of fine, generally uniform size. While applicants find particular utility for the needles of the present invention to promote atomization of liquids for CCVD and CACVD processes, and while the invention will be described herein to a substantial degree relative to these processes, it is to be understood that atomization using constricted needles in accordance with the present invention is applicable to a variety of processes where aerosols are used and which can benefit from control of aerosol formation, such as uniformity of flow and droplet size.

Uniformity and reproducibility of coating or powder production in a CCVD or CACVD process depends upon the ability to provide aerosols of known and reproducible characteristics, such as flow rate and droplet size.

The above-referenced U.S. Pat. No. 5,997,956 teaches CCVD processes in which "near-supercritical" fluids are atomized, such fluids being atomized at temperatures near to the supercritical temperature ($T_c$), e.g., within about 50° C. of supercritical. Such fine atomization is also important for other applications, such as in the fields of combustion, chemical processing, spraying, particle pressure regulation, analysis, catalysis, desiccation, and powder formation. While the atomization of supercritical or near-supercritical liquids produces aerosols of fine droplet size, the high pressures and high temperatures involved in some cases make it difficult to control the atomization so as to maintain a uniform aerosol. The nozzle of CCVD atomizers is typically a needle of very narrow inner diameter, i.e., in the range of 30 to 500 microns. When operating at near supercritical temperatures, problems can occur if the fluid crosses the liquidus and gasifies within the needle. If the liquid gasifies the dissolved solids, such as precursor(s), may precipitate within the needle, resulting in non-uniform deposition and eventually clogging the needle. Also, gasification of the liquid may result in oscillation within the needle causing cyclical flow variations. The resulting pulsed atomizing can cause significant variations in the proceeds and result in non-uniform product.

The present invention is directed to reducing the tip inner diameter of narrow inner diameter needles, preferably by at least about 25%, more preferably at least about 50% and even more preferably in many instances at least about 70%. The reduced tip diameter needles help to maintain a back pressure that increases the boiling point of the liquid in the needle and thereby prevents premature gasification of the liquid, resulting in more uniform depositions.

SUMMARY OF THE INVENTION

In accordance with the present invention, cylindrical, narrow inner diameter needles are reduced in their inner diameter at their tips to produce back pressures at the nozzles when pressurized liquids are fed through the needles. The needle, at least in a region extending upstream from an outlet or tip end, have a wide range of internal diameters (IDs), and a preferred first inner diameter of between about 30 and about 500 microns, preferably between about 50 and about 250 microns. A second constricted diameter in the region of the tip end is reduced relative to the first diameter by at least about 25%, preferably at least about 50%, more preferably at least 70%, up to about 95%.

As one preferred method of constricting the tip of a needle which originally has a first inner diameter at the tip and extending upstream therefrom, the tip of the needle is dipped in an plating bath, such as an electroless plating bath on electroplating bath, for a time sufficient for metal, e.g., nickel, to build up along the tip, including the interior surface of the tip. The deposited metal constricts the needle passageway at a region adjacent the tip to the second, narrower diameter. By such metal plating, a flared needle opening is produced which promotes good flow of liquid from the needle. In some cases, the needle tip is first prepared with a flash of electroplating so as to build up a seed layer of the metal to be deposited.

DETAILED DESCRIPTION OF CERTAIN PREFERRED EMBODIMENTS

Figure 1A:
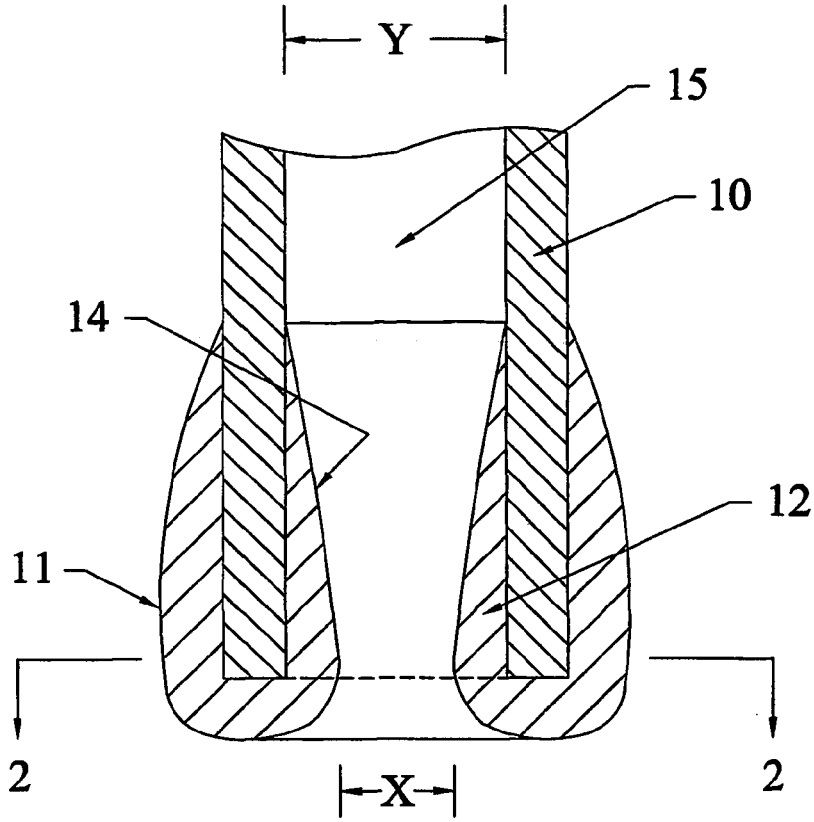
FIG. 1A is an axial or longitudinal cross-sectional view of a needle having a reduced-inner diameter tip in accordance with the invention.
Figure 1B:
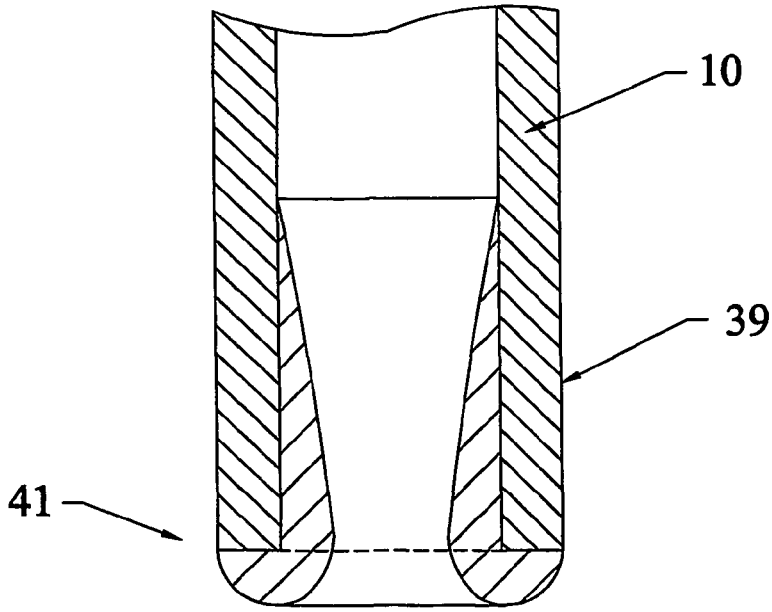
FIG. 1B is an axial cross-sectional view of an alternative embodiment of a needle having a reduced-inner diameter tip in accordance with the invention.
Figure 2:
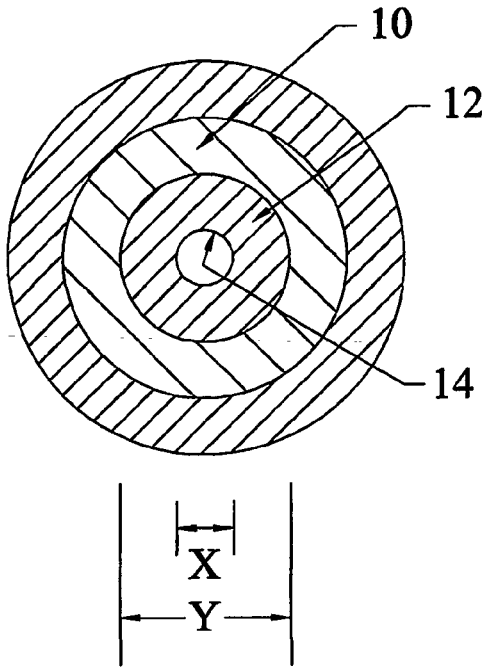
FIG. 2 is a trans-axial cross-sectional view of the needle taken along line 2—2 of FIG. 1.

With reference to FIG. 1, there is shown a cross-sectional view of an elongated cylindrical tube or needle 10, originally having a narrow inner first diameter (Y), i.e., between about 10 and about 200 microns, typically between about 30 and about 500 microns, more preferably between about 50 and about 250 microns, is plated at its tip 11 with a coating 12 of metal so as to produce a restriction at its most narrow location 14 of reduced second inner diameter (X). One specific needle that has been narrowed in diameter has an original ID of between 100 and 120 microns. To meaningfully aid liquid flow and uniform atomization of the liquid upon exiting the needle 10, second inner diameter X is reduced at least about 25% relative to first inner diameter Y, preferably at least about 50%. The only limitation on the narrowness of the constriction 14 is that it must still pass liquid and at a reasonable rate for its purpose. Typically, inner diameter X is reduced relative to inner diameter Y no more than about 95% generally no more than about 90%. After reaching its largest constriction, the plating tapers off until, beyond a certain distance longitudinally inward from the tip, only un-coated, original inner surface 15 of diameter Y exists.

Figure 3:
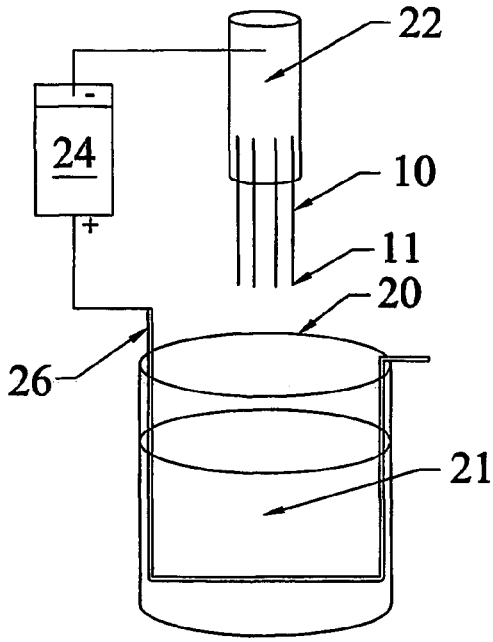
FIG. 3 is a perspective view of a set of needles prepared for dipping into an electroplating bath.
Figure 4:
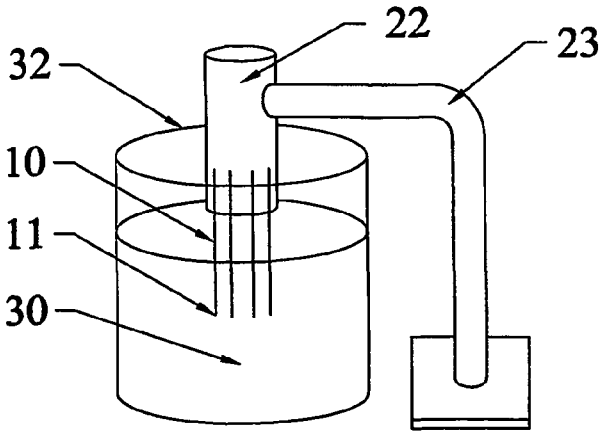
FIG. 4 is a perspective view showing the needles of FIG. 1 dipped into an electroless plating solution.

In a preferred method of reducing the diameter of the tip 11, with references, to FIGS. 3 and 4, the coating 12 is primarily built up by metal plating, particularly electroless plating (FIG. 4). Nickel is a currently preferred metal for providing coating 12 because of its hardness and durability under CCVD coating conditions; however, other metals, such as copper, chromium or various metal alloys may also be plated, e.g., by electroplating or electroless plating. It is also possible to narrow the diameter with compounds or composites containing compounds, such as nitrides, carbides, borides and oxides. If nickel is the metal of choice, the tip is preferably flashed in a nickel electroplating solution 21 contained in beaker 20 shown in FIG. 3 to provide a thin seed layer of nickel upon which additional nickel may be electroless plated. The solution 21 contains appropriate plating chemicals. From a DC power source 24, an electrical lead 26 dips into solution 21 to serve as the cathode. A conductive holder 22 is shown carrying a plurality of metal needles 10 and is electrically connected to the negative terminal of the power source 24 so that the tips of the needles, when dipped into the solution 21, serve as the anode. Electroplating is carried out long enough to provide enough nickel on the tip to promote efficient electroless plating. The nickel flash is important for coating substrates, such as stainless steel, which are difficult to coat directly by electroless plating. The flash provides a seed layer upon which additional metal can be electroless plated.

The plurality of nickel-flashed needles 10 carried by holder 22 on support 23 is dipped into an electroless plating solution 30 contained in beaker 32. The needles are dipped into the solution 30 only to a depth sufficient to submerge the tip portion on which coating is desired. Coating is continued until sufficient nickel builds up as coating 12 on the tip 11 to constrict the tip to second diameter X. The amount of coating 12 deposited is dependent upon the bath content, time, and temperature, and if these variables are kept constant, from run to run, the diameter reduction of the needles is generally reproducible.

An advantage of the coating method of the present invention is that the coating 12 is flared at both an upstream end 36 and a downstream exit end 38. This flared configuration promotes smooth flow of liquid through the constricted tip 11 and assists in dispersing the atomized liquid as the liquid exits the tube.

It can be beneficial to remove the added material on the outside of the needle so that the fluid to be atomized is less likely to build up at the tip. Alternatively, the outside 39 of the end of the needle 10 can be protected, e.g., masked, from plating, giving the tip configuration 41 seen in FIG. 1B. Masking may be by accomplished by wrapping the needle in a masking material. Alternatively, a substance, such as an oil, may be applied to the outer surface or the needle such that electroplating does not occur along the outer surface or, in any case, remain on the outer surface.

The invention is not limited to needles in which the tip constriction is produced by electroless plating or electroplating. The coating 12, for example, could be built up entirely by vapor deposition or precipitation, in which case a wider variety of materials may be formed. The more chemically stable, non-interactive, and tribologically sound, the more preferred the coating material.

Alternatively, the build-up of material may be carried out for a time sufficient to nearly close off the opening or entirely close off the opening. The opening may then be re-formed or enlarged by drilling, such as laser drilling, mechanical drilling, or chemical etching. Certain drilling methods may give a more precise and repeatable inside tip diameter.

The tip of the needle may also be constricted by depositing material at the tip with a deposition technique, such as a chemical vapor deposition technique, including combustion chemical vapor deposition as described above. In such a technique, the outer surface of the needle may be appropriately masked, e.g., by covering the outer surface with a material, such as an oil, to which the vapor deposition material will not adhere. It is desired that the material be deposited in such a manner that deposition proceeds at least about 1 mm into the inner surface of the needle, preferably at least about 3 mm. Because the inner diameter of the needle is already small, the vapor may tend not to travel to any significant distance within the tube. To enhance penetration into the tube, the interior of the tube may be at reduced pressure relative to the atmosphere outside the tube. This may be done either by drawing a vacuum through the tube or increasing the pressure outside of the tube.

While the invention is described herein primarily in terms of constricting a metal needle, needles formed of other materials may also be constricted in accordance with the invention. If the material of which the needle is formed, e.g., silica or other glass, is not amenable to metal plating, the tip may be constricted by means such as a vapor deposition or precipitation process. For example, a silica needle may be constricted with additional deposit of silica produced by CCVD. Alternatively, the tip of such material may be coated at the tip with a seed layer, e.g., platinum, by CCVD. Thereafter, metal material may be built up by metal plating, either electroplating or electroless plating.

Figure 5:
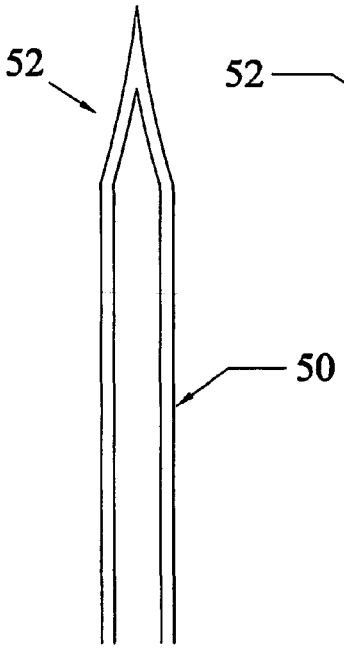
FIG. 5 is a cross-sectional view of a needle pinched off at one end.
Figure 6:
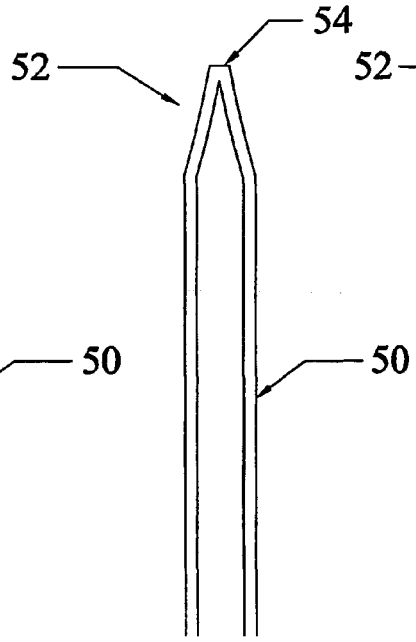
FIG. 6 is a cross-sectional view of the needle of FIG. 5 with its pinched-off end cut and polished to a smooth end.
Figure 7:
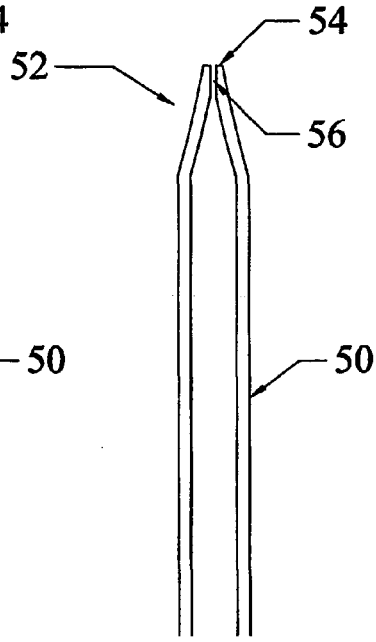
FIG. 7 is a cross-sectional view of the needle of FIG. 6 in which a narrow end opening has been drilled.

Another method of making a narrow inner diameter needle with a substantially more restricted opening is shown in reference to FIGS. 5–7. The needle 50 is pinched at its outlet end 52 to entirely close the opening as seen in FIG. 5. The pinched-off end 52 may be then cut and polished to form a flat surface 54 at the closed end normal to the axis of the needle as seen in FIG. 6. As shown in FIG. 7, a narrow bore 56 is then drilled from the flat surface 54 having an inner diameter substantially reduced from the original inner diameter of the needle as described in reference to the FIG. 1–4 embodiment.

Figure 8:
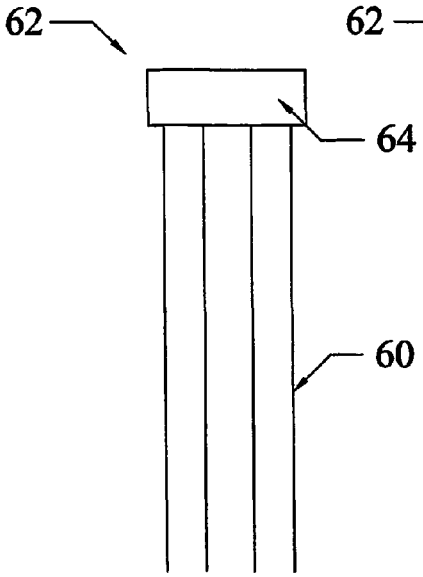
FIG. 8 is a cross-sectional view of a thick-walled, narrow bore needle to which an end plug has been soldered.
Figure 9:
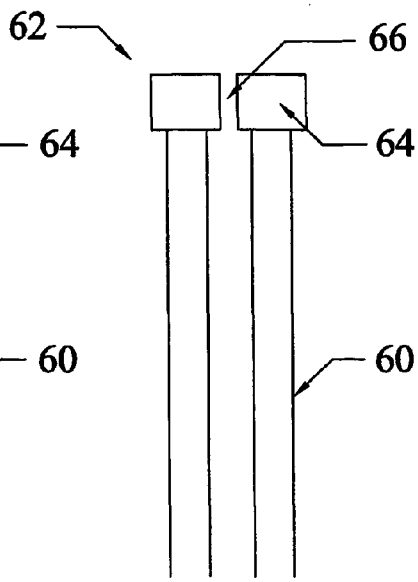
FIG. 9 is a cross-sectional view of the needle of FIG. 8 in which a narrow end opening has been drilled.

Another way of first closing off the end of a needle 60 and reforming a restricted inner diameter tip 62 is seen in reference to FIGS. 8 and 9. A plug 64 is soldered or welded onto the end of the needle. To facilitate this step, a thick-walled needle 60 with an appropriately narrow inner diameter is chosen as the starting needle, providing a relatively large surface area at its end to which the plug 64 is welded. Preferably, in such a thick-walled needle, the outer diameter of the needle is at least about four times the inner diameter. Next, the tip 62 is drilled, e.g., with laser or chemically etched, to form the narrow diameter bore 66.

A primary utilization of the reduced diameter needles of the present invention is for atomization of fluids, such as fluids used in CCVD. In such process, pressurized fluid is passed through the needle. Typically, thermal energy is supplied to the needle to heat the fluid passing therethrough and thereby control the droplet size of the aerosol that forms.

Figure 10:
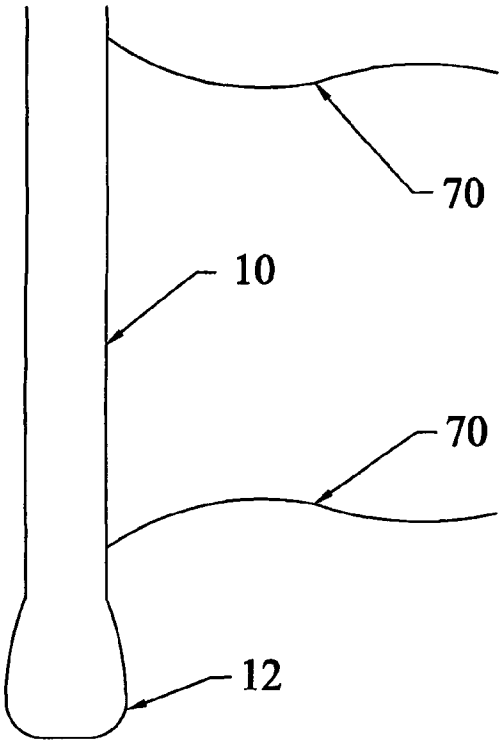
FIG. 10 is an elevation view of a needle to which are attached, at longitudinally spaced locations, electrical leads by which the needle may be resistively heated.

Illustrated in FIG. 10 is a metal needle 10, constricted in accordance with the invention. As the needle 10, including its outer surface, is electrically conductive, a pair of electrical leads 70 are attached at longitudinally spaced-apart locations on the needle whereby current may be passed through the needle to resistively heat the needle. To this end, the needle should have some meaningful electrical resistance, i.e., at least about 0.2 ohms per centimeter, preferably at least about 0.5 ohms per centimeter, more preferably at least about 2 ohms per centimeter.

Figure 11:
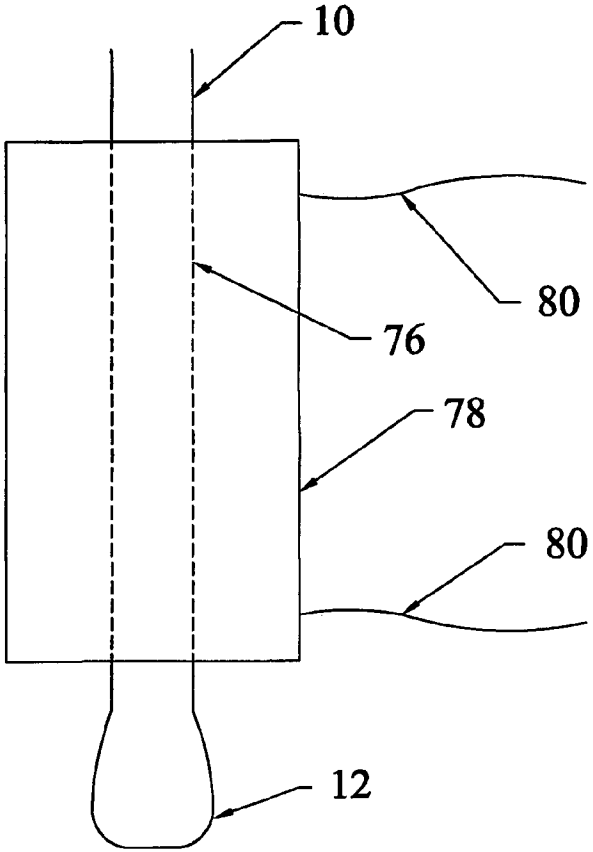
FIG. 11 is an elevation view of a needle which is jacketed in thermally conductive material, which, is illustrated connected to a pair of electrical leads at longitudinally spaced locations, whereby the thermally conductive material may be heated and in turn heat the needle.

The needle 10, whether formed from a metal or a non-metal, such as silica, can be jacketed with a heat transfer material 78, such as shown in FIG. 11. In this embodiment, the needle is in heat transfer relationship with the jacket, preferably with its outer surface 76 in direct surface contact with the jacketing, thermally conductive material 78. In FIG. 11, the jacketing heat-transfer material 78 is shown connected to a pair of electrical leads 80 at spaced-apart locations for resistively heating the jacketing material. Other means may also be used for heating the jacketing material, such as surrounding heating coils, inductive heating means, a heated fluid jacket, etc. Such jacketing material may be especially indicated when the needle is either formed of electrically non-conducting material that cannot be heated by resistive heating or formed of highly electrically conducting material that can be heated by resistive heating only with excessively high current. However, this method can be used to heat a needle formed of any material.

Figure 12A:
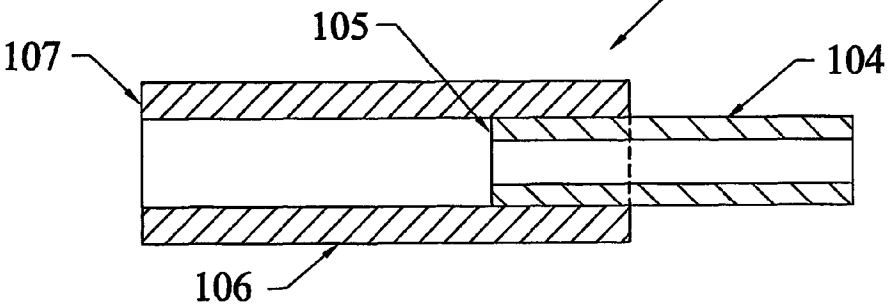
FIGS. 12A and 12B show cross-sectional views of constricted diameter needles formed by inserting a smaller needle segment into a larger needle segment.
Figure 12B:
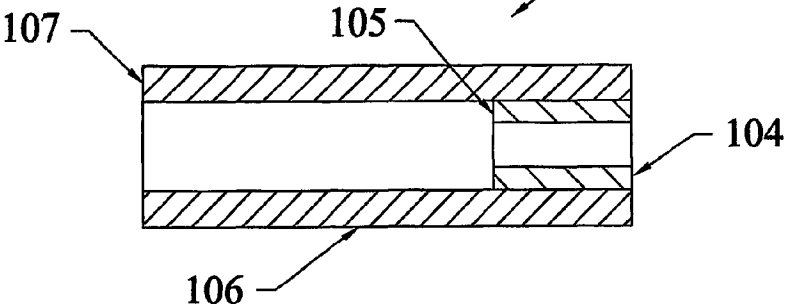

Another manner in which to form a reduced ID (inner diameter) needle 100 and 102 (FIGS. 12A and 12B) is to have a narrower ID needle segment 104 glued, welded, soldered or by other means, inserted into and attached to the ID of slightly larger needle segment 106. In this case, the larger needle segment may have IDs ranging from 50 to 500 microns, typically 100 microns to 300 microns, even up to 1,000 microns. The OD (outside diameter) of the smaller needle segment 104 is just slightly smaller than that of the ID of the larger needle segment 106 and the ID of the smaller needle segment is materially smaller than the ID of the larger needle, generally at least 25% less, preferably at least about 50% less, and in many cases at least 70% less. Typically, the ID of the smaller needle segment is 80 microns or less, preferably 50 microns or less, down to about 5 microns. The length of the smaller needle segment 104 to be inserted in the larger needle segment 106 can vary from 1 millimeter to a few centimeters—preference is from 3 millimeters to 2 centimeters. The insert needle segment 104 can protrude outward of the outlet end of the larger needle segment as seen in FIG. 12A or the outlet end of the insert needle segment can be flush to the outlet end of the larger needle segment as seen in FIG. 12B. It is preferred to have the smaller needle segment slightly protruding outward of the larger needle as per the FIG. 12A embodiment. So as to leave a larger ID chamber before the constriction, the inner end 105 of the insert segment 104 does not extend to the inner end 107 of the larger segment 106.

Attachment of the insert needle segment to the inner wall of the larger needle segment is preferably accomplished using a compatible, high-temperature glue. The glue used to adhere the two needle segments needs to be able to withstand the temperature required for the proper atomization of the deposition fluid and also must be compatible with the chemicals contained in the fluid. Examples of good adhesive materials are types of high-temperature solders, polyimide-based polymers or high temperature epoxies.

Another way of achieving a reduced ID needle tip is to heat and draw the material. This can be done with metals, glasses or even some ceramic materials. It can also be achieved with polymeric materials. In particular, this method is preferred for glass tubing. A glass needle can be heated in a small, localized area, then is drawn at a certain rate which causes elongation and a resulting narrowing of the ID. This can be cut and polished yielding a smaller ID outlet end. The narrowing will be in the temperature range near the glass transition temperature where the material is softened. It can be fairly uniform. The cut can be made so that there is only a narrow taper. Alternative, the cut can provide a taper followed by a set length of reduced ID material.

If the needle is formed of glass or other material that is non-conductive of electricity, the needle cannot be heated directly by resistive heating but must be energized directly by an external heating source or through a jacket of heat transfer material, as described above. Non-conductive needles may be used without any significant addition of energy if the fluid atomizes at ambient temperatures under use conditions which may only involve pressurization of the fluid.

Figure 13:
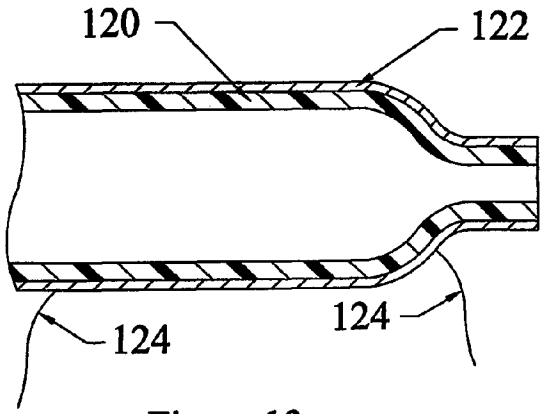
FIG. 13 shows a restricted diameter needle formed of electrically non-conductive needle, coated with an electrically conductive material, and attached to electrodes for resistive heating.

If the conditions in the area for atomization require fluid of temperatures of 20° C., 50° C., 100° C. or higher localized pre-heating of the liquid may be done upstream of the needle such that the fluid atomizes upon exiting the needle. As seen in FIG. 13, a reduced diameter tip needle 120 formed of non-electrically conductive material, such as glass, might be provided a coating 122 of electrically conductive material such as silver, e.g., by a sputtering process, allowing two electrodes 124 to be attached to provide for resistive heating of the unitary needle structure.

While a primary utility of constricted tip needles in accordance with the invention is for atomization, the needles may be used for other purposes, such as dispersing medications, printing, coating, micro-fluid control, and supplying gases, such as oxygen, or supplying a pilot flame to a combustion chemical vapor deposition (CCVD).

While a tube is preferred for many applications, any structure with a narrow orifice may be further reduced in size to yield a structure of the present invention. The interior diameters need not be round, but can be any shape and the shape of the reduced ID need not be the same shape as the original ID. Herein, if either the initial cross-section of the orifice is non-circular or the reduced cross-section of the orifice is non-round, the limitations as to initial cross sectional area from a larger initial ID to a reduced ID of a circular cross-section apply to non-circular cross-sectional orifices An important aspect of the spray and many circumstances would be the shape and the direction of the spray. For such applications, a round shaped spray may not be best suited, therefore, it can be of great advantage to have a fan type spray or square or rectangular type spray. These types of sprays can be formed by changing the end of the spray device disclosed herein. The main feed line could be round or square or elliptical or any shape. The key is the shape of the tip piece that is important in controlling the spray shape. The preferred shape for this feed line is round as these are easiest to manufacture in most methods but could be of any shape. The tip end can be elongated by etching or lasering a line rather than a round hole or by forming a round end and then mechanical deforming it to an elongated shape. Square patterns, rectangular patterns can be produced by lasering, etching or mechanical means including forming a glass body of larger size and then pulling it until it reduces in size to the final desired size. That way larger scale pre-forms with easier to form shapes on the ID can be realized.

EXAMPLE

A plurality of stainless steel needles, each having an inner diameter Y of 100 microns and an outer diameter of 200 microns, were first sonicated in toluene for 10 minutes, soaked in an 30% HCl acid pickle bath for one minute, and rinsed in deionized water for two minutes.

The tips 11 of the needles 10 were then electroplated in a nickel strike solution 21. The needles were attached to a copper holder 22 that was connected to the negative terminal of the DC power source 24. A nickel anode 26 was also inserted into the solution 21 and connected to the positive terminal of the power source 24. Current passed through the needles 10 was 15 mA, and deposition continued for 15–20 minutes. The nickel strike solution was an aqueous solution of $NiCl.6H_2O$ 122 grams per liter and HCl 200 grams per liter.

The tips 11 of the needles 10 were then submerged to a depth of 21.5 cm. in an electroless nickel plating bath 30 which was an aqueous solution of 6 grams per liter Ni with a pH of 5. The solution had a temperature of 90° C. and the tips of the needles were soaked for 120–150 minutes. The inner diameter X of the needles 10 at its most constricted location 14 was reduced to 50 microns.

What is claimed is:

1. A needle having a cylindrical portion of a first inner diameter of less than 500 microns in diameter extending to a tip portion having a constriction of a second inner diameter reduced relative to said first inner diameter by at least about 25%, wherein said constriction is provided by material deposited on said tip portion, said material extending at least about 1 mm along the interior surface of said tip portion and wherein at least a longitudinal portion of said needle is in thermal contact with a heat transfer means formed of thermally conducting material, whereby said longitudinal portion may be heated through said heat transfer means.

2. The needle according to claim 1 wherein said heat transfer means fully surrounds said longitudinal portion.

3. The needle according to claim 1 wherein said heat transfer means is in surface contact with said longitudinal portion.

4. The needle according to claim 1 in combination with temperature adjusting means for adjusting the temperature of said longitudinal portion of said needle through said heat transfer means.

5. The needle according to claim 1 in combination with heating means for heating said needle through said heat transfer means.

6. The needle according to claim 1 wherein said needle is formed of a non-metal material.

7. The needle according to claim 6 wherein said needle includes a coating of electrically conducting material extending longitudinally along said needle.

8. The needle according to claim 7 wherein said coating is connected to a pair of longitudinally spaced electrical leads for electrically heating said needle.

9. The needle according to claim 1 wherein the first inner diameter has a first cross-sectional area between about 0.002 millimeter$^2$ and about 4 millimeters$^2$.

10. The needle of claim 1 wherein said second inner diameter is reduced relative to said first inner diameter by at least about 50% .

11. The needle of claim 1 wherein said second inner diameter is reduced relative to said first inner diameter by at least about 70% .

12. The needle of claim 1 wherein said first cross-section is circular.

13. The needle of claim 1 wherein said second inner diameter has a reduced cross-section, and said reduced cross-section is circular.

14. The needle of claim 1 wherein said second inner diameter has a reduced cross-section, and said reduced cross-section is elliptical.

15. The needle of claim 1 wherein said second inner diameter has a reduced cross-section, and said reduced cross-section is rectangular.

16. The needle of claim 1 wherein said second inner diameter has a reduced cross-section, and said reduced cross-section is square.

17. The needle according to claim 1 wherein said constriction is provided by material deposited on said tip portion, said material extending at least about 3 mm along the interior surface of said tip portion.

18. An electrically conducting needle having a cylindrical portion of a first inner diameter of less than 500 microns in diameter extending to a tip portion having a constriction of a second inner diameter reduced relative to said first inner diameter by at least about 25% , wherein said constriction is provided by material deposited on said tip portion, said material extending at least about 1 mm along the interior surface of said tip portion, and a pair of electrical leads are attached at longitudinally spaced-apart locations on said needle whereby current may be passed through the needle to resistively heat said needle.

19. The needle according to claim 18 wherein said second inner diameter is reduced relative to said first inner diameter by at least about 50%.

20. The needle according to claim 18 wherein said second inner diameter is reduced relative to said first inner diameter by at least about 70%.

21. The needle according to claim 18 wherein said constriction is provided by material deposited on said tip portion, said material extending at least about 3 mm along the interior surface of said tip portion.

22. The needle according to claim 18 wherein said needle has a resistance of at least about 0.2 ohms per centimeter.

23. The needle according to claim 18 wherein said needle has a resistance of at least about 0.5 ohms per centimeter.

24. The needle according to claim 18 wherein said needle has a resistance of at least about 2 ohms per centimeter.

25. The needle according to claim 18 wherein said needle has an exposed electrically conductive outer surface to which said electrical leads are connected.

26. The needle according to claim 18 wherein the first inner diameter has a first cross-sectional area between about 0.002 millimeter$^2$ and about 4 millimeters$^2$.

27. The needle of claim 18 wherein said needle is made of metal.

* * * * *